US007011135B2

(12) United States Patent
Kato et al.

(10) Patent No.: US 7,011,135 B2
(45) Date of Patent: Mar. 14, 2006

(54) APPARATUS FOR PRODUCING A COMPOSITE MATERIAL INCLUDING CERAMIC HOLLOW PARTICLES AND ALUMINUM OR ALUMINUM ALLOY AND METHOD FOR PRODUCING THE COMPOSITE MATERIAL THE SAME

(75) Inventors: Takayuki Kato, Susono (JP); Hiroshi Suzuki, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/804,221

(22) Filed: Mar. 19, 2004

(65) Prior Publication Data

US 2004/0238148 A1 Dec. 2, 2004

(30) Foreign Application Priority Data

Mar. 20, 2003 (JP) ..... P2003-078687

(51) Int. Cl.
*B22D 19/02* (2006.01)
*B22D 19/14* (2006.01)

(52) U.S. Cl. ..... 164/97; 164/133; 164/337

(58) Field of Classification Search ..... 164/97–98, 164/133–136, 335–337
See application file for complete search history.

(56) References Cited

U.S. PATENT DOCUMENTS

| | | | | | |
|---|---|---|---|---|---|
| 3,615,880 | A * | 10/1971 | Barto et al. | ..... | 148/545 |
| 4,909,300 | A * | 3/1990 | Horie | ..... | 164/69.1 |
| 5,299,619 | A * | 4/1994 | Chandley et al. | ..... | 164/53 |
| 5,348,071 | A * | 9/1994 | Cook | ..... | 164/61 |
| 5,524,697 | A * | 6/1996 | Cook | ..... | 164/97 |
| 2002/0179273 | A1 * | 12/2002 | Ruhland | ..... | 164/97 |

* cited by examiner

*Primary Examiner*—Kuang Y. Lin
(74) *Attorney, Agent, or Firm*—Sughrue Mion, PLLC

(57) ABSTRACT

An apparatus 1 for producing a composite material including ceramic hollow particles and one of aluminum and aluminum alloy pressurizes a gas feeding member 20, a molten stock vessel 30, a packing 50, a forming mold 60 and an air-removal ceramic filter 80 by means of an upper pressure die 11 and a lower pressure die 12 and introduces an Ar gas thereby allowing molten aluminum 40 or molten aluminum alloy 40 to infiltrate in gaps between the plural ceramic hollow particles.

4 Claims, 2 Drawing Sheets

APPARATUS FOR PRODUCING A COMPOSITE MATERIAL INCLUDING CERAMIC HOLLOW PARTICLES AND ALUMINUM OR ALUMINUM ALLOY AND METHOD FOR PRODUCING THE COMPOSITE MATERIAL THE SAME

BACKGOURND OF THE INVENTION

1. Field of the Invention

The present invention relates to an apparatus for producing a composite material including ceramic hollow particles and aluminum or aluminum alloy, and to a method for producing the composite material including the ceramic hollow particles and aluminum or aluminum alloy.

2. Related Art

There have conventionally been known and used an apparatus and method for forming an aluminum member or an aluminum alloy member having a desired shape by melting aluminum or aluminum alloy, charging the resultant aluminum (or molten aluminum) or aluminum alloy (or molten aluminum alloy) in a forming mold, and then cooling the aluminum or aluminum alloy.

It is desirable that such an aluminum member or aluminum alloy member is further reduced in weight but further increased in strength.

SUMMARY OF THE INVENTION

In view of the foregoing, the invention has been accomplished. The invention has an object to provide an apparatus and method for producing the aluminum member or aluminum alloy member having a less weight but a higher strength than the conventional member.

For achieving the aforementioned object, the production apparatus according to the first aspect of the present invention is an apparatus for producing a composite material including ceramic hollow particles and aluminum or aluminum alloy comprising:

a molten stock vessel including: a vessel body including a gas inlet port at an upper part thereof and a molten stock outlet port at a bottom thereof; a chamber formed in the vessel body in a manner to intercommunicate the gas inlet port and the molten stock outlet port, and accommodating therein molten aluminum or molten aluminum alloy; and a temporary sealing ceramic filter disposed in the chamber as seated against the bottom of the chamber in a manner to cover the molten stock outlet port;

a gas feeding member including a member body formed with a gas infeed port for feeding a predetermined gas into the chamber of the molten stock vessel, and disposed on the upper part of the vessel body in a manner that the member body thereof covers the gas inlet port as allowing the gas infeed port thereof to be communicated with the gas inlet port;

a packing including a through hole, and seated against the bottom of the vessel body in a manner to allow the through hole thereof to be communicated with the molten stock outlet port;

a forming mold including: a mold body disposed under the molten stock vessel with the packing interposed therebetween; a slit formed in the mold body, communicated with the molten stock outlet port of the vessel body via the through hole of the packing, and accommodating therein a plurality of ceramic hollow particles; and a vent hole formed at the mold body in a manner to communicate with the slit, and extended from a bottom of the mold body to form an air vent;

an air-removal ceramic filter disposed under the forming mold, and seated against the bottom of the mold body in a manner to cover the air vent; and a pressure die for pressurizing an array of the gas feeding member, the molten stock vessel, the packing, the forming mold and the air-removal ceramic filter along the arrayed direction thereby bringing these components into tightly contacted relation, wherein when the predetermined gas is fed into the chamber of the molten stock vessel via the gas infeed port of the gas feeding member, the pressure of the gas causes the molten aluminum or the molten aluminum alloy to flow through the temporary sealing ceramic filter and into the slit of the forming mold and then to fill in gaps between the plural ceramic hollow particles.

For achieving the aforementioned object, the production method according to a second aspect of the present invention is for producing a composite material including ceramic hollow particles and aluminum or aluminum alloy comprising the steps of:

assembling a removable molten stock vessel including: a vessel body including a gas inlet port at an upper part thereof and a molten stock outlet port at a bottom thereof, a chamber formed in the vessel body in a manner to intercommunicate the gas inlet port and the molten stock outlet port, and a temporary sealing ceramic filter disposed in the chamber as seated against the bottom of the chamber in a manner to cover the molten stock outlet port,a gas feeding member including a member body formed with a gas infeed port for feeding a predetermined gas into the chamber of the molten stock vessel, and disposed on the upper part of the vessel body in a manner that the member body thereof covers the gas inlet port as allowing the gas infeed port thereof to be communicated with the gas inlet port;

a packing including a through hole, and seated against the bottom of the vessel body in a manner to allow the through hole thereof to be communicated with the molten stock outlet port;

a forming mold including: a mold body disposed under the molten stock vessel with the packing interposed therebetween; a slit formed in the mold body, and communicated with the molten stock outlet port of the vessel body via the through hole of the packing; and a vent hole formed at the mold body in a manner to communicate with the slit, and extended from a bottom of the mold body to form an air vent;

an air-removal ceramic filter disposed under the forming mold as seated against the bottom of the mold body in a manner to cover the air vent; and a pressure die for pressurizing an array of the gas feeding member, the molten stock vessel, the packing, the forming mold add the air-removal ceramic filter along the arrayed direction thereby bringing these components into tightly contacted relation;

a loading step for loading an aluminum ingot or an ingot of aluminum alloy in the chamber of the molten stock vessel dismounted from a predetermined assembly position;

a melting step for heating the molten stock vessel finished with the loading step thereby melting the aluminum ingot or the ingot of aluminum alloy into molten aluminum or molten aluminum alloy;

a heating and heat retaining step for heating the forming mold and retaining the forming mold at a predetermined temperature, the step performed after the charging of plural ceramic hollow particles in the slit of the forming mold and in parallel with the melting step;

a pressurizing step performed for pressurizing the component array along the arrayed direction by means of the pressure die, the step performed after the heating and heat retaining step for heating the forming mold is terminated and the molten stock vessel finished with the melting step is assembled on the packing; and a filling step performed after the pressurizing step for feeding the predetermined gas into the chamber of the molten stock vessel via the gas infeed port of the gas feeding member and utilizing the pressure of the gas to cause the molten aluminum or the molten aluminum alloy to flow through the temporary sealing ceramic filter and into the slit of the forming mold and then to fill in gaps between the plural ceramic hollow particles, wherein the feeding of the predetermined gas into the chamber of the molten stock vessel is terminated after the temperature of the forming mold is lowered to below a predetermined solidification temperature of the molten aluminum or the molten aluminum alloy, and wherein the composite material including the plural ceramic hollow particles and aluminum or aluminum alloy is released from the slit of the forming mold after the temperature of the forming mold is lowered to below a predetermined releasable temperature for the composite material.

According to the first and second aspects of the present invention, there may be produced a member having a less weight but a higher strength than the conventional member formed from aluminum or an aluminum alloy. That is, the invention provides for the production of the composite material including the ceramic hollow particles and aluminum or aluminum alloy.

DETAILED DESCRIPTION OF THE PREFEREED EMBODIMENTS

Figure 1:
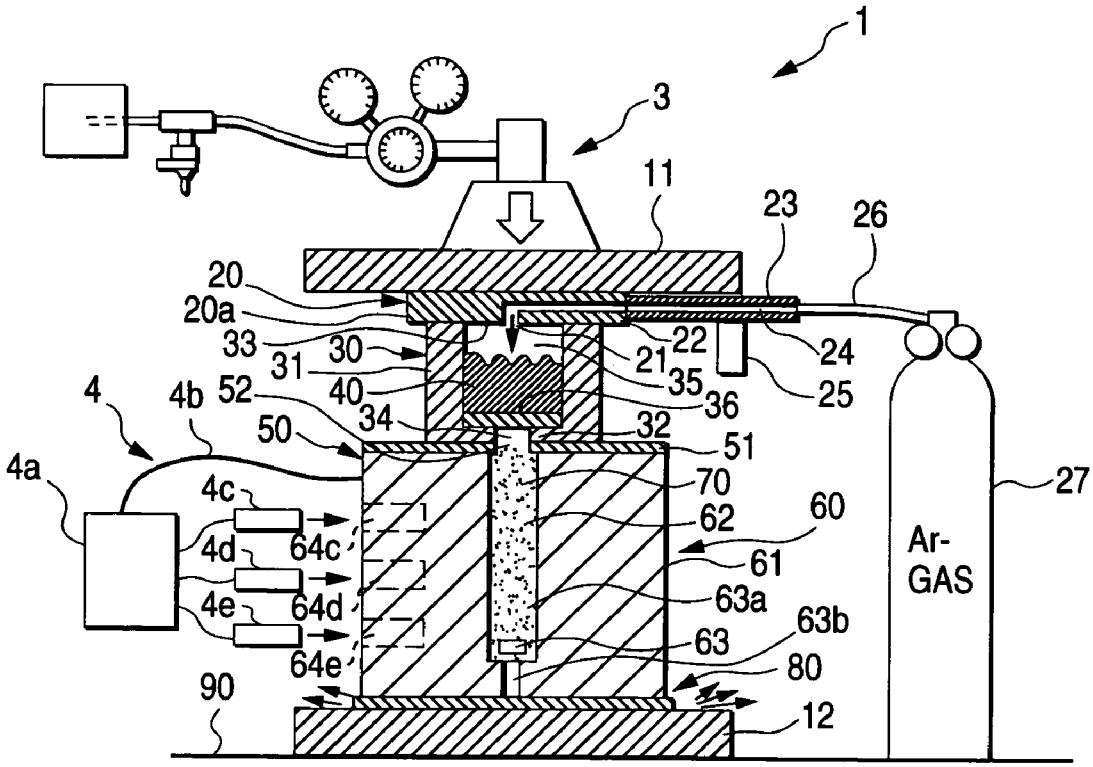
FIG. 1 is a vertical sectional view schematically showing an apparatus for producing a composite material including ceramic hollow particles and aluminum or aluminum alloy according to the invention.
Figure 2:
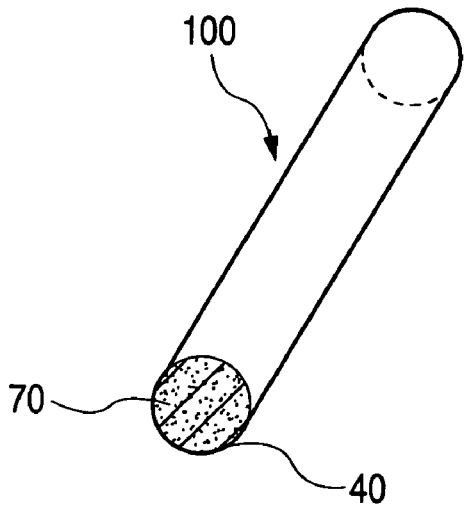
FIG. 2 is a perspective view showing an example of a member (or the composite material including the ceramic hollow particles and aluminum or aluminum alloy) produced by the production apparatus (production method) according to the invention.

A preferred embodiment of the invention will hereinbelow be described with reference to the accompanying drawings. FIG. 1 is a vertical sectional view schematically showing an apparatus for producing a composite material including ceramic hollow particles and aluminum or aluminum alloy according to the invention. FIG. 2 is a perspective view showing an example of a member produced by the inventive production apparatus (production method) (that is, the composite material including ceramic hollow particles and aluminum or aluminum alloy).

As shown in FIG. 1, an apparatus 1 for producing the composite material including the ceramic hollow particles and aluminum or aluminum alloy in accordance with the invention includes: a gas feeding member 20; a molten stock vessel 30; a packing 50; a forming mold 60; and an air-removal ceramic filter 80. The apparatus adopts a mode wherein these components are interposed between an upper pressure die 11 formed from a metal and a lower pressure die 12 formed from a metal.

The lower pressure die 12, the air-removal ceramic filter 80, the forming mold 60, the packing 50, the molten stock vessel 30, the gas feeding member 20 and the upper pressure die 11 are arranged upward in a vertical line from an installation surface 90 of the production apparatus 1 in the order named (in other words, the components are stacked on top of each other). When pressed downwardly by a pressing device 3, the upper pressure die 11 cooperates with the lower pressure die 12 to pressurize the gas feeding member 20, molten stock vessel 30, packing 50, forming mold 60 and air-removal ceramic filter 80 along the arrayed direction thereby bringing these components into tightly contacted relation. It is noted that in a case where the installation surface 90 has as high strengths against pressure and heat as the lower pressure die 12, the lower pressure die 12 may be dispensed with.

The molten stock vessel 30 includes: a vessel body 31 including a gas inlet port 33 at an upper part thereof and a molten stock outlet port (a circular aperture having a diameter of 10 mm) at a bottom thereof; a chamber 35 formed in the vessel body 31 in a manner to intercommunicate the gas inlet port 33 and the molten stock outlet port 34; and a temporary sealing ceramic filter 36 disposed in the chamber 35 as seated against a bottom 32 of the chamber 35 in a manner to cover the molten stock outlet port 34. The temporary sealing ceramic filter 36 may be formed from one type of ceramic material or from plural types of ceramic materials (ceramics). The molten stock vessel 30 is removably assembled in the production apparatus 1. The vessel 30 may be readily disassembled from the apparatus by taking the steps of: moving the upper pressure die 11 upwardly, and removing the gas feeding member 20.

The gas feeding member 20 includes a member body **20*a* formed from graphite and defining therein a gas injection passage 22. The member body 20*a* is in air-tight connection with a junction member 23 including a hollow portion 24. A gas hose 26 from a gas cylinder 27 is passed through the hollow portion 24 of the junction member 23 as fitted therein in an air-tight manner. A gas flow passage in the gas hose 26 is communicated with the gas injection passage 22 of the gas feeding member 20. Thus, the gas feeding member 20 is supplied with a predetermined gas (an Ar (argon) gas according to the embodiment) from the gas cylinder 27 via the gas hose 26. Incidentally, the gas cylinder 27 includes a regulator (not shown) at an upper end thereof. The regulator (not shown) may be manipulated so as to control the flow rate of the Ar gas (in other words, the gas pressure) fed from the gas cylinder 27 into the gas feeding member 20. The junction member 23 includes a selector valve 25. The selector valve 25 is a three-way valve operative to evacuate the Ar gas from the molten stock vessel 30 and the forming mold 60** and to refill them with the external air, the vessel and mold cooled after the introduction of the Ar gas is terminated by the regulator (not shown).

The member body **20*a* of the gas feeding member 20 is formed with a gas infeed port 21 for introducing the Ar gas into the chamber 35 of the molten stock vessel 30, the infeed port 21 communicated with the gas injection passage 22. The gas feeding member 20 is disposed on the upper part of the vessel body 31 in a manner that the member body 20*a* thereof covers the gas inlet port 33 as allowing the gas infeed port 21 thereof to be communicated with the gas inlet port 33 of the molten stock vessel 30. The upper pressure die 11 applies pressure for bringing the gas feeding member 20 into air-tight connection with the molten stock vessel 30**.

The chamber 35 of the molten stock vessel 30 accommodates there in molten aluminum 40 or molten aluminum alloy 40. The vessel is provided with the temporary sealing ceramic filter 36 for temporarily sealing the molten stock outlet port 34 such that the molten aluminum 40 or the molten aluminum alloy 40 may be prevented from flowing out through the molten stock outlet port 34 when the molten stock is not subjected to the pressure of the Ar gas. Specifically, the temporary sealing ceramic filter 36 has a characteristic not to permit the passage (permeation) of the molten aluminum 40 or the molten aluminum alloy 40 therethrough unless the pressure of the Ar gas exceeds a predetermined value.

The packing 50 disposed under the molten stock vessel 30 includes a packing body 51 formed from graphite. The packing body 51 includes a through hole 52 and is seated against the bottom 32 of the vessel body 31 as allowing the through hole 52 thereof to be communicated with the molten stock outlet port 34 of the molten stock vessel 30. The packing 50 is interposed between the molten stock vessel 30 and the forming mold 60 and forms as an air-tight connection between the molten stock vessel 30 and the forming mold 60 as pressurized by the upper pressure die 11.

The forming mold 60 includes a mold body 61 formed from graphite and is disposed under the molten stock vessel 30 with the packing 50 interposed therebetween. The mold body 61 is formed with a slit 62 communicated with the molten stock outlet port 34 of the molten stock vessel 30 via the through hole 52 of the packing 50, and a vent hole 63 communicated with the slit 62 and extended from a bottom of the mold body 61 to form an air vent 63*b*. While the embodiment adopts the slit 62 having a cylindrical internal space in order to produce the cylindrical member 100 (that is, the composite material including ceramic hollow particles and aluminum or aluminum alloy) as shown in FIG. 2, the slit 62 may be formed in any shape according to a desired shape of the member 100.

Figure 3:
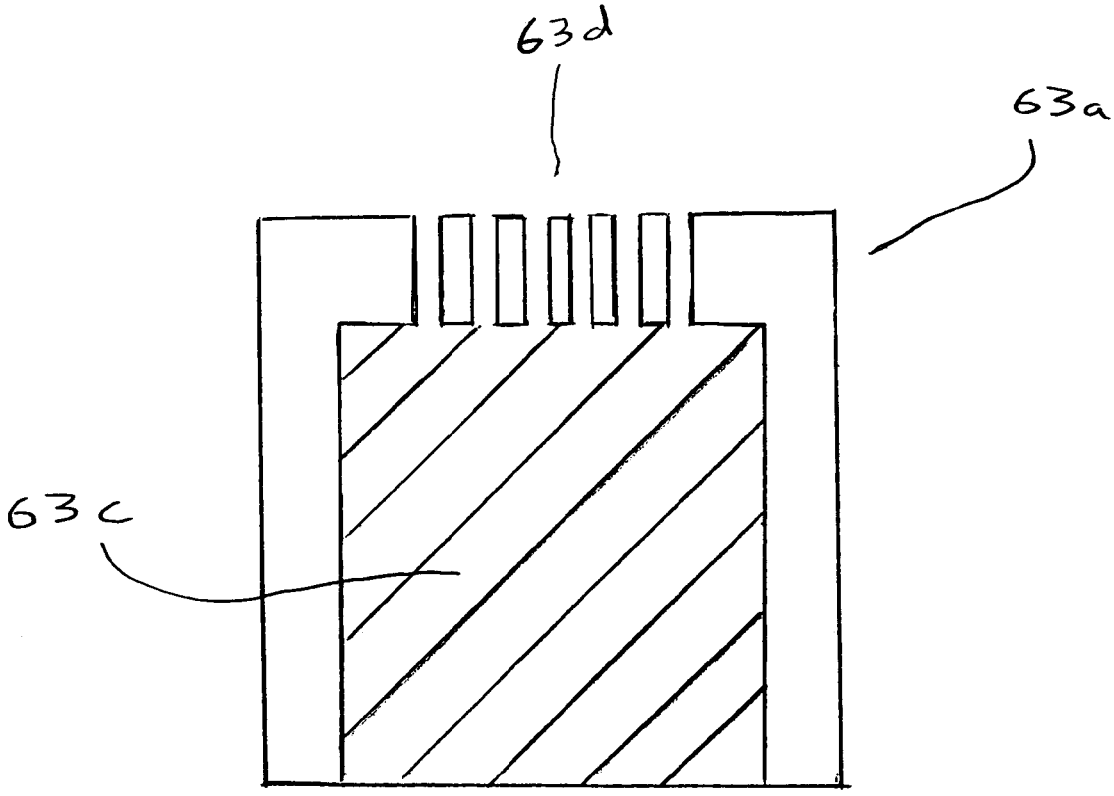
FIG. 3 is a vertical sectional view showing a vent member and an anti-leakage ceramic filter disposed in the vent member.

The vent hole 63 is provided with a metallic vent member 63*a*, and an anti-leakage ceramic filter 63*c* disposed in the vent member 63*a* in a manner to cover the air vent 63*b* for preventing the leakage of the molten stock. An upper side of the vent member 63*a*, that faces the slit 62, is formed with a plurality of grooves 63*d*. The anti-leakage ceramic filter 63*c*, shown in FIG. 3 with metallic vent member 63*a* and plurality of grooves 63*d*, may be formed from one type of ceramic material or from plural types of ceramic materials (ceramics). However, it is preferred that the ceramic filter has characteristics to permit the passage of the air caused to flow out of the slit 62 by the pressure of the Ar gas and to inhibit the passage (permeation) of the molten aluminum 40 or the molten aluminum alloy 40 therethrough.

The air-removal ceramic filter 80 is disposed under the forming mold 60 and is seated against the bottom of the mold body 61 in a manner to cover the air vent 63*b*. The air-removal ceramic filter 80 may be formed from one type of ceramic material or from plural types of ceramic materials (ceramics). The air-removal ceramic filter has a characteristic to permit the passage of the air caused to flow out of the air vent 63*b* by the pressure of the Ar gas.

A procedure (steps) for producing the member 100 shown in FIG. 2 using the aforesaid production apparatus 1 will be described as below. It is noted that numerical values cited in the following description are mere examples and that the invention is not limited by such numerical values in any way.

First, the temporary sealing ceramic filter 36, as removed from the molten stock vessel 30, is placed in an oven such as an electric furnace (not shown) so as to be sufficiently heated at 400° C. for 30 minutes for fully evaporating (dissipating) moisture contained in the temporary sealing ceramic filter 36 (that is, a heating and moisture dissipating step).

Next, the temporary sealing ceramic filter 36 finished with the heating and moisture dissipating step is assembled in the molten stock vessel 30 in a manner to be seated against the bottom 32 of the chamber 35 for covering the molten stock outlet port 34. Thereafter, an aluminum ingot or an ingot of aluminum alloy is loaded in the chamber 35 (that is, a loading step). A preferred ingot of aluminum alloy may be exemplified by ADC-12. Where the ADC-12 has a density of 2.68 g/cm$^3$, the ADC-12 has compositions including: 3.3 wt % of Cu (copper), 11 wt % of Si (silicon), less than 1.3 wt % of Fe (iron) and more than 84.4 wt % of Al (aluminum).

Next, the molten stock vessel 30 finished with the loading step is placed in the oven such as an electric furnace (not shown) in which the vessel is heated at 700° C. for melting the aluminum ingot or the ingot of aluminum alloy into the molten aluminum 40 or the molten aluminum alloy 40 (that is, a melting step).

After plural ceramic hollow particles 70 are charged in the slit 62 of the forming mold 60, the forming mold 60 is heated by means of a cartridge heater 4, as a heating and heat retaining device, and retained at a predetermined temperature (550° C.) (that is, a heating and heat retaining step), the heating and heat retaining step performed in parallel with the melting step. As shown in FIG. 1, the cartridge heater 4 includes: a mold temperature controller 4*a*; a thermocouple 4*b* electrically connected with the mold temperature controller 4*a*; and a plurality of heating and heat retaining elements 4*c*, 4*d*, 4*e* electrically connected with the mold temperature controller 4*a*. The thermocouple 4*b* has its distal end, as a temperature sensing portion, fixed to place on a lateral outside of the mold body 61 of the forming mold 60, whereas the heating and heat retaining elements 4*c*, 4*d*, 4*e* are inserted in plural holes 64*c*, 64*d*, 64*e* formed in the lateral outside of the mold body 61, respectively. The mold temperature controller 4*a* senses the temperature of the mold body 61 based on a voltage value given by the thermocouple 4*b* so as to energize the heating and heat retaining elements 4*c*, 4*d*, 4*e* in a manner to retain the temperature thereof at the set value of 550° C. for heating (or retaining the temperature of) the mold body 61. It is noted that the bodies of the ceramic hollow particles 70 may be formed from one type of ceramic material or from plural ceramic materials (ceramics), the bodies each defining a sealed hollow space therein.

Subsequently, the cartridge heater 4 stops the heat retaining operation for the forming mold 60. The molten stock vessel 30 finished with the melting step is seated upon the packing 50 while the gas feeding member 20 is properly mounted on the top of the molten stock vessel 30. Subsequently, the pressing device 3 is operated to press the upper pressure die 11 at 5.0 Mpa (megapascal), thereby pressurizing the gas feeding member 20, molten stock vessel 30, packing 50, forming mold 60 and air-removal ceramic filter 80 along the arrayed direction (that is, a pressurizing step). It is preferred that confirmation of the fully pressurized gas feeding member 20, molten stock vessel 30, packing 50, forming mold 60 and air-removal ceramic filter 80 by means of the upper pressure die 11 and lower pressure die 12 is also made by visual observation before the pressurizing step is terminated.

The termination of the pressurizing step is followed by introducing the Ar gas into the chamber 35 of the molten stock vessel 30 via the gas infeed port 21 of the gas feeding member 20. The pressure of the gas (0.93 MPa according to the embodiment) is utilized for forcing the molten aluminum 40 or molten aluminum. alloy 40 through the temporary sealing ceramic filter 36 and into the slit 62 of the forming mold 60, thereby allowing the molten stock to infiltrate in gaps between the plural ceramic hollow particles 70 (that is, an infiltrating step). In this process, the air present in the gaps between the plural ceramic hollow particles 70 is discharged through the air-removal ceramic filter 80 as indicated by arrows shown in FIG. 1.

After the temperature of the forming mold 60 is lowered to below a predetermined solidification temperature of the molten aluminum 40 or molten aluminum alloy 40 (514° C. in the aforementioned case of the ACD-12), the introduction of the Ar gas into the chamber 35 of the molten stock vessel 30 is terminated.

After the temperature of the forming mold 60 is lowered to below a predetermined releasable temperature for the composite material (300° C. to room temperatures), the composite material including the plural ceramic hollow particles and aluminum or aluminum alloy is released from the slit 62 of the forming mold 60. The composite material thus released is subjected to a suitable finishing step such as cutting or polishing, thus shaped into the member 100 as shown in FIG. 2. The resultant member 100 has a less weight but a higher strength than the conventional member formed from aluminum or aluminum alloy.

It is noted that the invention is not limited by the foregoing embodiment but modifications, improvements and such may be made thereto as required. The shapes, modes, numbers, numerical values, locations and such of the components of the foregoing embodiment are not limited so long as the components can realize the invention.

For instance, although the foregoing embodiment employs the vessel body of the molten stock vessel and the mold body of the forming mold which are formed from graphite, the invention is not limited by this and may employ the bodies formed from a metal.

As described above, the invention provides for the production of the member having a less weight but a higher strength than the conventional aluminum member, or in other words, the production of the composite material including the ceramic hollow particles and aluminum or aluminum alloy.

What is claimed is:

1. An apparatus for producing a composite material including ceramic hollow particles and one of aluminum and aluminum alloy comprising:

a molten stock vessel including a vessel body including a gas inlet port at an upper part thereof and a molten stock outlet port at a bottom thereof; a chamber formed in said vessel body in a manner to intercommunicate said gas inlet port and said molten stock outlet port, and accommodating therein molten aluminum or molten aluminum alloy; a temporary sealing ceramic filter disposed in said chamber as seated against said bottom of said chamber in a manner to cover said molten stock outlet port;

a gas feeding member including a member body formed with a gas infeed port for feeding a predetermined gas into the chamber of said molten stock vessel, and disposed on the upper part of said vessel body in a maimer that said member body thereof covers said gas inlet port as allowing said gas infeed port thereof to be communicated with said gas inlet port;

a packing including a through hole and seated against the bottom of said vessel body in a manner to allow the through hole thereof to be communicated with said molten stock outlet port;

a forming mold including a mold body disposed under said molten stock vessel with said packing interposed therebetween; a slit formed in the mold body, communicated with the molten stock outlet port of said vessel body via the through hole of said packing, and accommodating therein a plurality of ceramic hollow particles; a vent hole formed at said mold body in a manner to communicate with the slit, and extended from a bottom of said mold body to form an air vent;

an air-removal ceramic filter disposed under said forming mold and seated against the bottom of said mold body in a manner to cover said air vent; and a pressure die for pressurizing an array of said gas feeding member, said molten stock vessel, said packing, said forming mold and said air-removal ceramic filter along an arrayed direction thereby bringing these components into tightly contacted relation, wherein when said predetermined gas is fed into the chamber of said molten stock vessel via the gas infeed port of said gas feeding member, the pressure of the gas causes said molten aluminum or said molten aluminum alloy to flow through said temporary sealing ceramic filter and into the slit of said forming mold and then to fill in gaps between said plural ceramic hollow particles.

2. A method for producing a composite material including ceramic hollow particles and one of aluminum and aluminum alloy comprising the steps of:

loading an aluminum ingot or an ingot of aluminum alloy in a chamber of a molten stock vessel dismounted from a predetermined assembly position;

heating said molten stock vessel to melt said aluminum ingot or said ingot of aluminum alloy into molten aluminum or molten aluminum alloy;

heating and heat retaining a forming mold at a predetermined temperature, after charging plural ceramic hollow particles which are in the slit of said forming mold and in parallel with said melting step;

pressurizing an array of a gas feeding member, said molten stock vessel, a packing, said forming mold and an air-removal ceramic filter along an arrayed direction by a pressure die after terminating said heating and heat retaining step for heating said forming mold and assembling said molten stock vessel, which includes said molten aluminum or said molten aluminum alloy, on the packing; and infiltrating said molten aluminum or said molten aluminum alloy in gaps between said plural ceramic hollow particles by feeding said predetermined gas into the chamber of said molten stock vessel via a gas infeed port of said gas feeding member and utilizing the pressure of the predetermined gas to cause said molten aluminum or said molten aluminum alloy to flow through a temporary sealing ceramic filter and into the slit of said forming mold.

3. A method for producing a composite material including ceramic hollow particles and one of aluminum and aluminum alloy as claimed in claim 2, wherein the feeding of said predetermined gas into the chamber of said molten stock vessel is terminated after the temperature of said forming mold is lowered to below a predetermined solidification temperature of said molten aluminum or said molten aluminum alloy.

4. A method for producing a composite material including ceramic hollow particles and one of aluminum and aluminum alloy as claimed in claim 2, wherein the composite material including said plural ceramic hollow particles and one of aluminum and aluminum alloy is released from the slit of said forming mold after the temperature of said forming mold is lowered to below a predetermined releasable temperature for the composite material.

* * * * *